United States Patent [19]

Pitel et al.

[11] 4,023,704

[45] May 17, 1977

[54] HELICAL FEED MERCHANDISING MACHINE

[75] Inventors: Irving Pitel, Edison; Richard S. Silverman, Springfield; Richard J. Mueller, Mountain Lakes, all of N.J.

[73] Assignee: Rowe International Inc., Whippany, N.J.

[22] Filed: Mar. 25, 1974

[21] Appl. No.: 454,118

[52] U.S. Cl. ..... 221/75; 221/129; 221/281

[51] Int. Cl.² ..... G07F 11/36

[58] Field of Search ..... 221/75, 94, 287, 197, 221/153, 129, 13, 281; 312/323; 200/307, 293, 340, 329; 197/102–104; 194/10, DIG. 19; 271/149, 150, 129

[56] References Cited

UNITED STATES PATENTS

| | | | |
|---|---|---|---|
| 2,163,145 | 6/1939 | Johnson | 271/150 |
| 2,546,690 | 3/1951 | Gabrielsen | 194/DIG. 19 |
| 2,975,935 | 3/1961 | Hebel | 194/10 X |
| 3,057,511 | 10/1962 | Mannhardt | 221/75 |
| 3,320,010 | 5/1967 | Ritzerfeld | 312/323 |
| 3,344,953 | 10/1967 | Krakauer et al. | 221/75 |
| 3,441,174 | 4/1969 | Kenney | 221/75 |
| 3,589,492 | 6/1971 | Shirley | 194/10 |
| 3,591,045 | 7/1971 | Sturrock | 221/75 |
| 3,653,540 | 4/1972 | Offutt | 221/75 |
| 3,752,287 | 8/1973 | Cullum | 194/10 |
| 3,773,217 | 11/1973 | Schlaf | 221/75 |
| 3,831,807 | 8/1974 | Deaton et al. | 221/85 |

FOREIGN PATENTS OR APPLICATIONS

| | | |
|---|---|---|
| 481,788 | 3/1938 | United Kingdom |

*Primary Examiner*—Robert B. Reeves
*Assistant Examiner*—John P. Shannon
*Attorney, Agent, or Firm*—Shenier & O'Connor

[57] ABSTRACT

A versatile merchandising machine for dispensing a variety of goods including bagged snacks and the like in which each of a plurality of delivery units of one of a number of vertically spaced shelves includes a pair of horizontally aligned oppositely wound helices which receive articles between aligned pairs of turns of the helices and in which selectively energisable individual detent motors respectively drive the helices of the pairs in opposite directions to advance the leading article of the unit into engagement with an article control element hanging down in front of the unit to guide the article to control its movement over the edge of the shelf and downwardly to a delivery area. The shelves can be slid outwardly and swung downwardly through a limited arc to facilitate loading.

15 Claims, 12 Drawing Figures

Fig 2
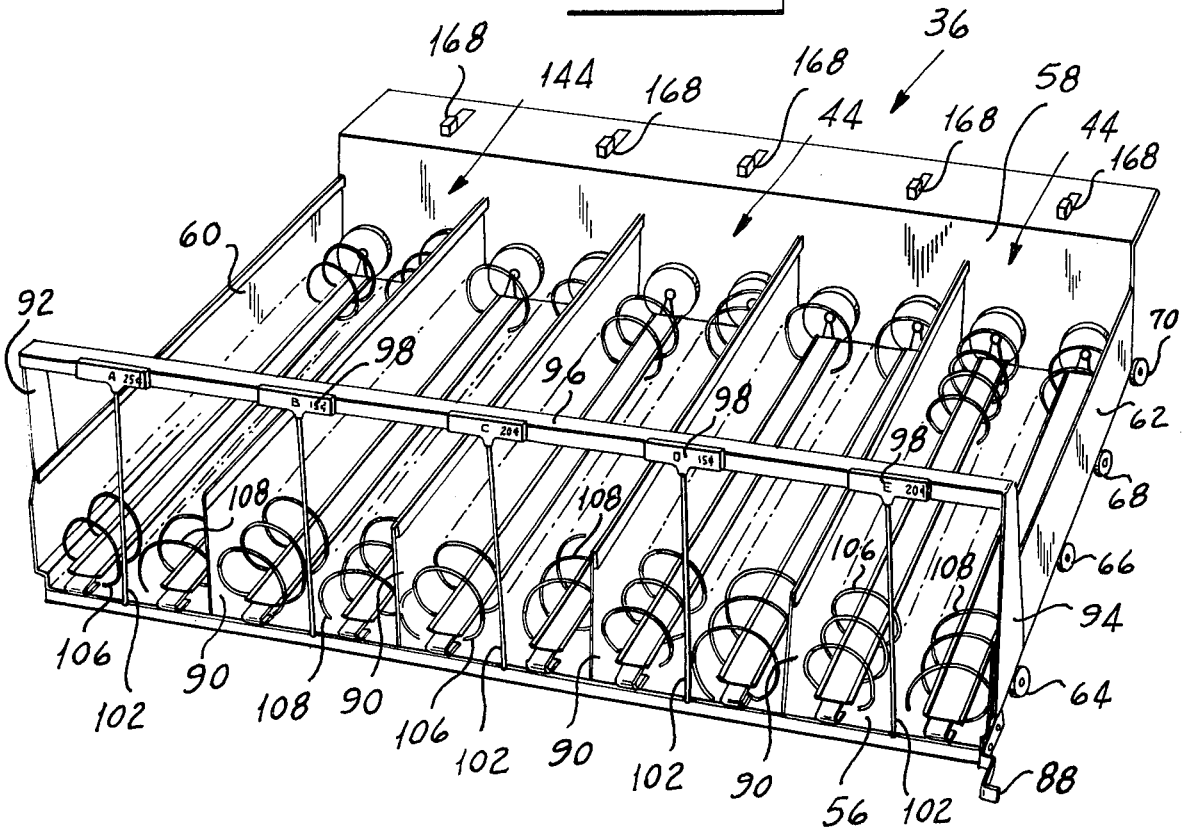
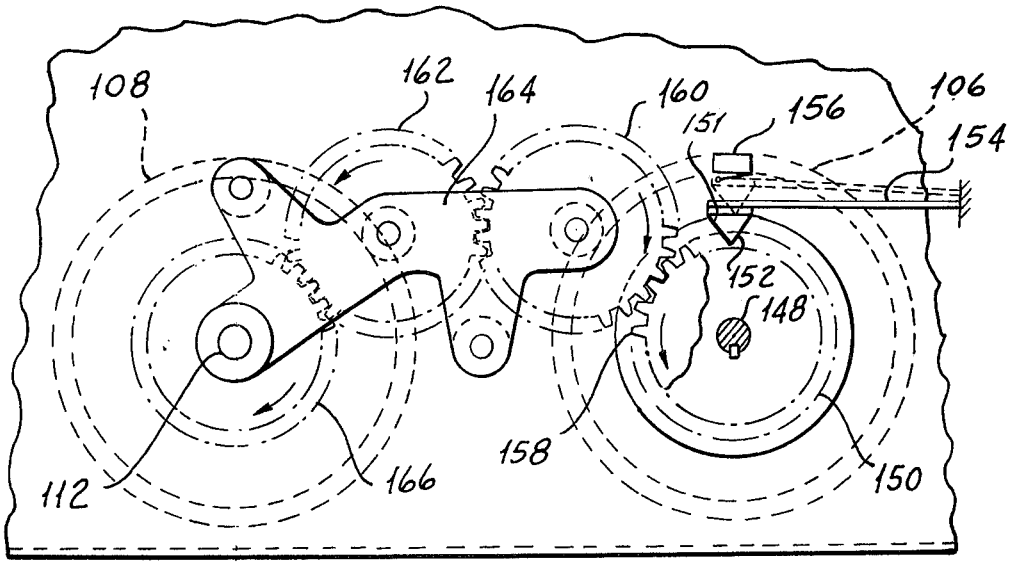
Fig 9

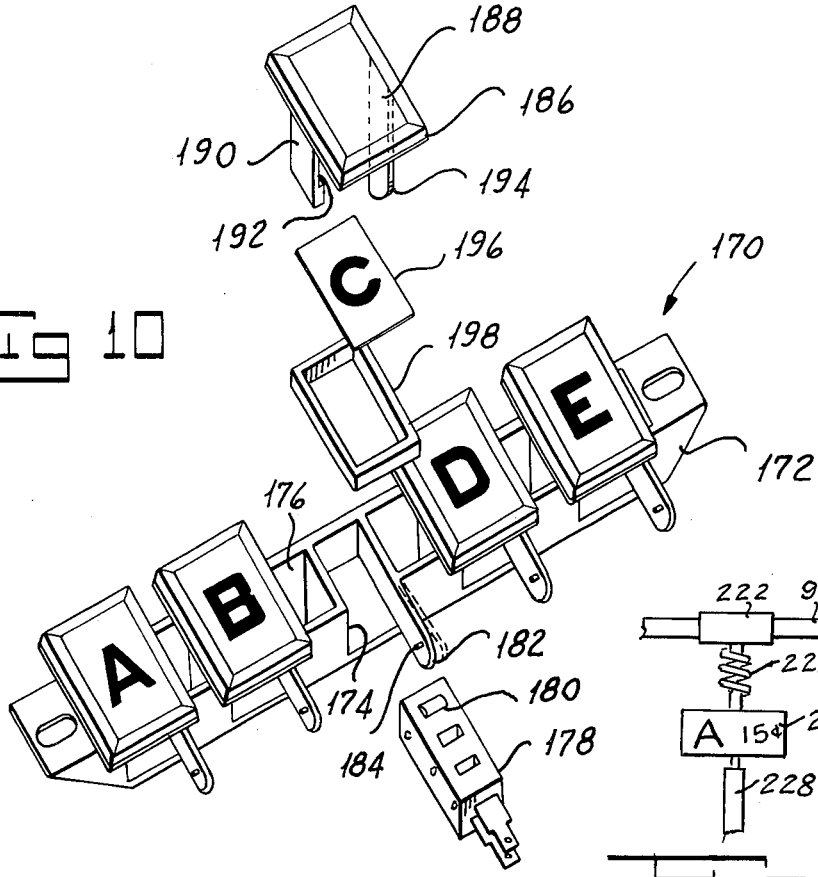
Fig 10
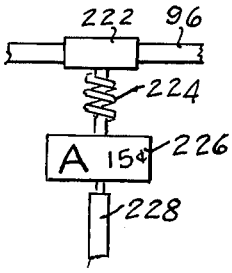
Fig 12
Fig 11
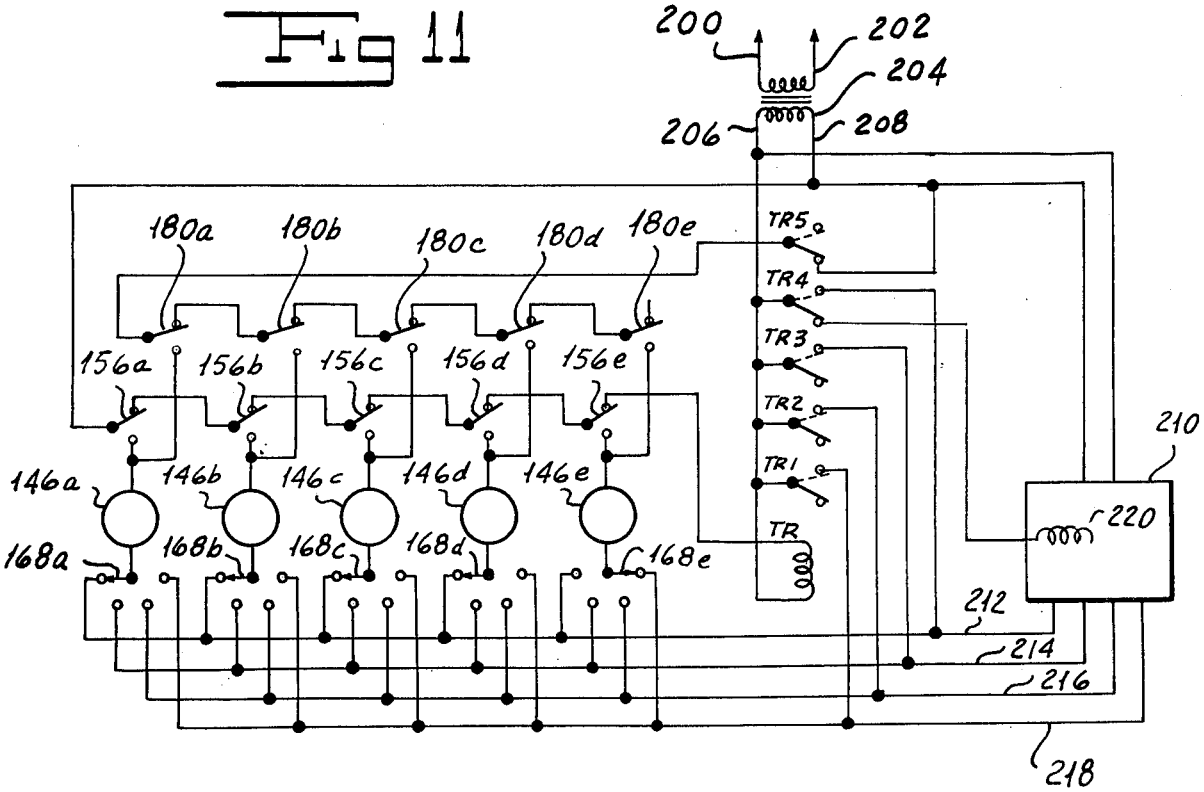

HELICAL FEED MERCHANDISING MACHINE

BACKGROUND OF THE INVENTION

Various forms of merchandising machines are known in the prior art. For example, there are known machines of the type in which a helix receiving articles between adjacent turns thereof is driven to advance the leading article over the edge of a shelf or the like to permit it to fall to a delivery area. Machines of this type may be provided with a multiplicity of such helices together with selectively operable means for driving the helices to deliver different articles. These machines are especially adapted to dispense light articles such as bagged snacks.

Machines of the prior art of the type described above incorporate a number of disadvantages. First, the movement of light articles from the storage shelf to the delivery area is not controlled so that an article is likely to become wedged between the cabinet door window and part of the operating mechanism or a lower shelf. Secondly, machines of the type described above are difficult to load. Owing to the complexity of the helix itself, cleaning of the machines is difficult. The selective drive mechanism of machines incorporating a plurality of helices is so complicated as to make maintenance and repair difficult. Moreover, this complexity adds to the cost of the machine.

We have invented a versatile merchandising machine which overcomes the disadvantages of machines of the prior art pointed out hereinabove. Our machine is certain in operation. It minimizes the possibility of failure of a dispensed article to reach the delivery area. Our machine is easy to load. The merchandise holding parts of our machine are readily disassembled for cleaning and readily reassembled. Our selective drive mechanism is relatively simple as compared with arrangements of the prior art.

SUMMARY OF THE INVENTION

One object of our invention is to provide a versatile merchandising machine which overcomes the defects of helical feed merchandising machines of the prior art.

Another object of our invention is to provide a versatile merchandising machine which minimizes the possibility that a dispensed article will not reach the delivery area.

A further object of our invention is to provide a versatile merchandising machine which is relatively easy to clean.

Still another object of our invention is to provide a versatile merchandising machine which has a relatively simple operating mechanism.

A still further object of our invention is to provide a versatile merchandising machine which is easy to load.

Other and further objects of our invention will appear from the following description.

In general, our invention contemplates the provision of a versatile merchandising machine in which each delivery unit of a plurality of units on one of a number of vertically spaced shelves includes a pair of horizontally aligned oppositely wound helices adapted to receive articles between adjacent pairs of turns of the helices and a selectively operable detent motor adapted to drive the helices in opposite directions to advance the leading article into engagement with a resilient guide element extending downwardly in front of the unit to control movement of the article over the edge of the shelf and downwardly to a delivery area. Each shelf is mounted for movement outwardly and pivotal movement downwardly through a limited arc to facilitate loading of the units of the shelf.

BRIEF DESCRIPTION OF THE DRAWINGS

In the accompanying drawings which form part of the instant specification and which are to be read in conjunction therewith and in which like reference numerals are used to indicate like parts in the various views:

FIG. 2 is a perspective view of one of the shelves of the form of our versatile merchandising machine illustrated in FIG. 1.

FIG. 3 is a fragmentary sectional view of one of the shelves of the form of our versatile merchandising machine illustrated in FIG. 1.

FIG. 9 is a fragmentary sectional view of the unit illustrated in FIG. 7 taken along the line 9—9 thereof.

FIG. 10 is an exploded perspective view of the push button mounting assembly of our versatile merchandising machine.

FIG. 11 is a schematic view of one form of electrical circuit which can be used with our versatile merchandising machine.

FIG. 12 is a fragmentary view of an alternate form of our article guide rod.

DESCRIPTION OF THE PREFERRED EMBODIMENT

Figure 1:
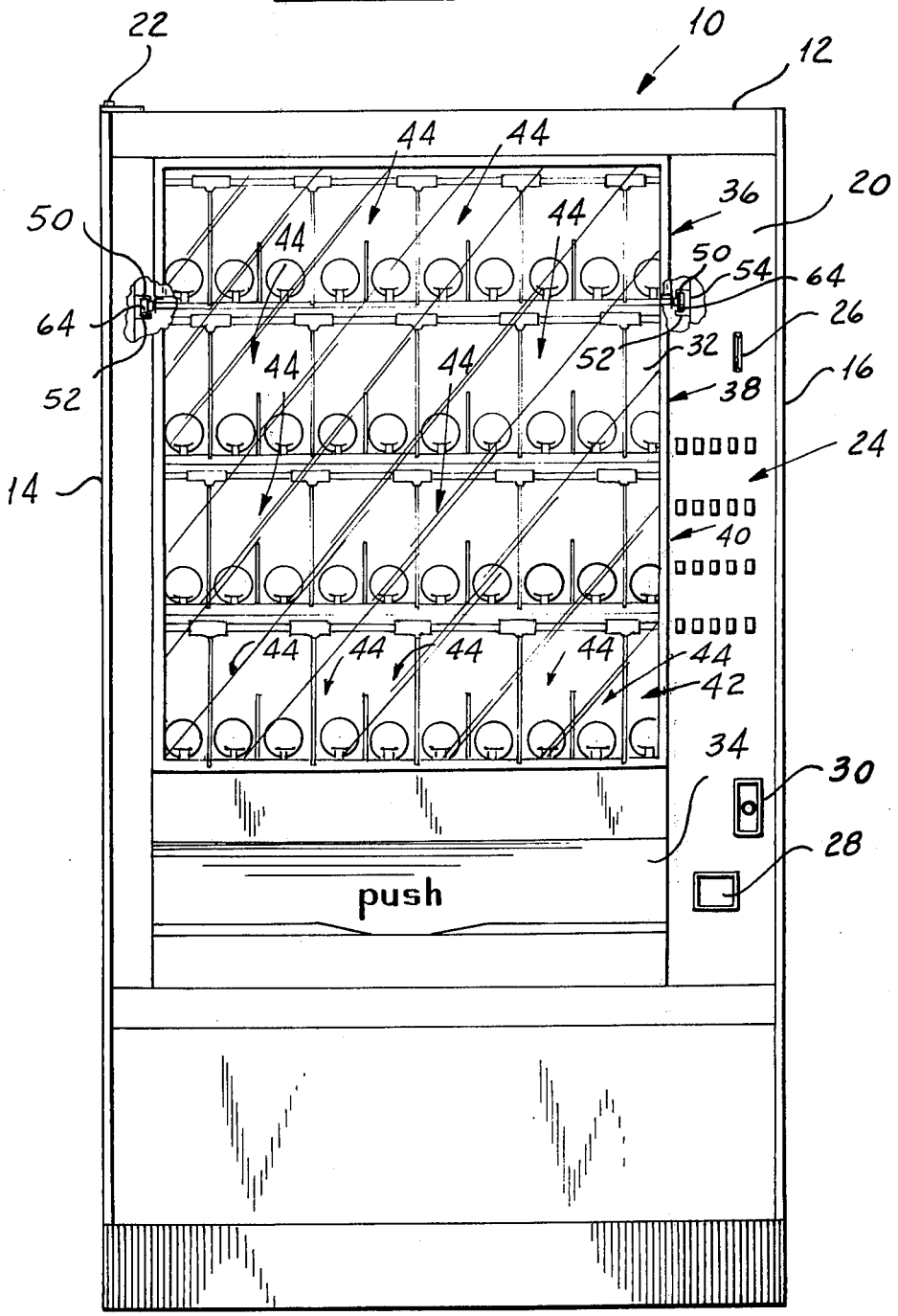
FIG. 1 is a front elevation of our versatile merchandising machine.
Figure 5:
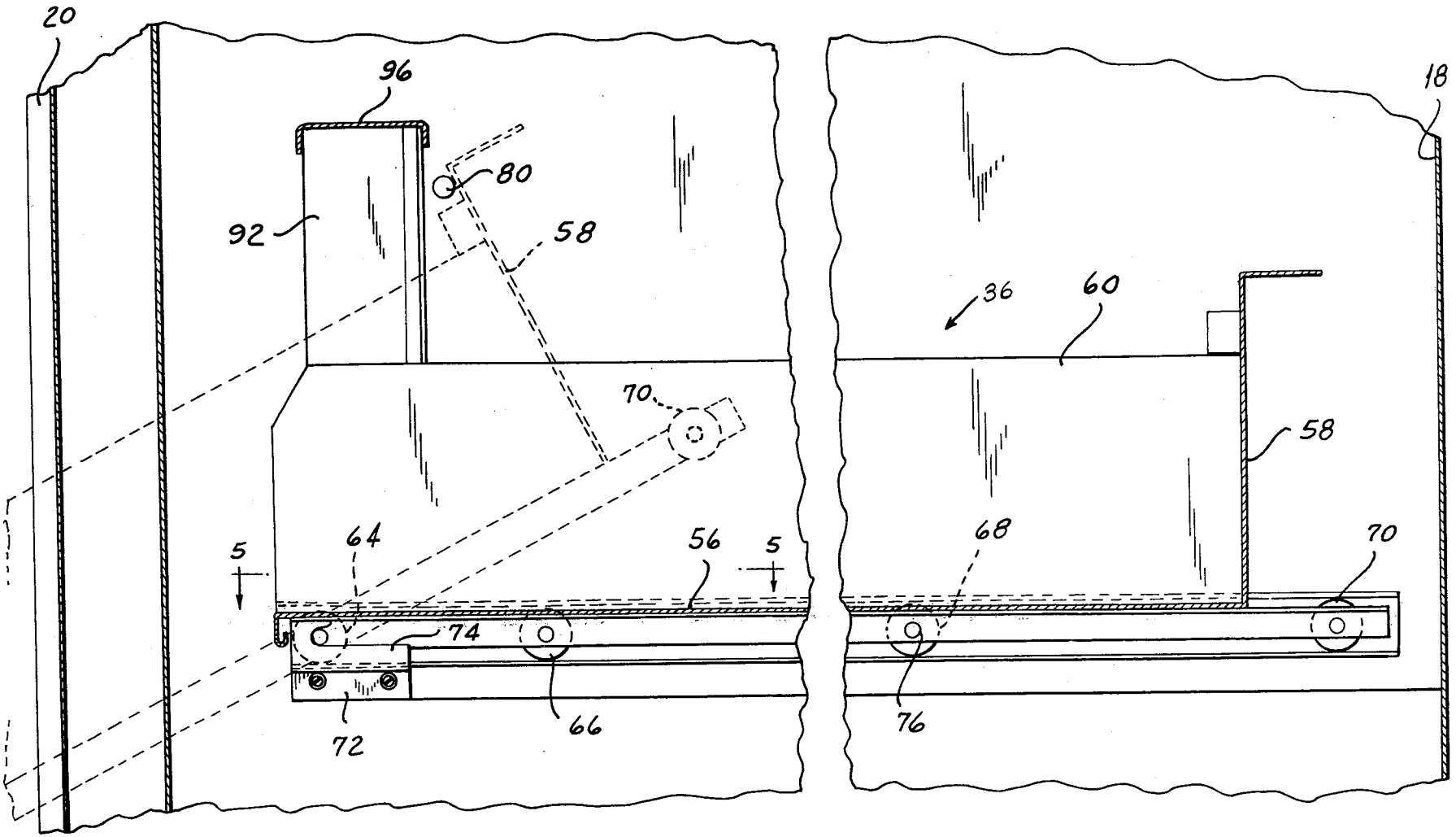
FIG. 5 is a fragmentary sectional view of one of the levels of our versatile merchandising machine.
Figure 4:
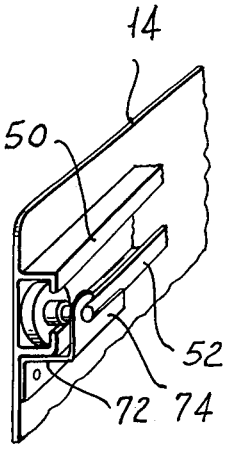
FIG. 4 is a fragmentary perspective view of one of the levels of our versatile merchandising machine.

Referring now to FIGS. 1 to 5 of the drawings our versatile merchandising machine, indicated generally by the reference character 10, includes a cabinet 12 having sides 14 and 16 and a back 18. The open front of the cabinet 12 is adapted to be closed by a door 20 carried by a hinge 22 on the cabinet. Door 20 supports an array 24 of push buttons, a coin slot forming member 26, a coin return tray 28 and a lock 30. A window 32 in the door 20 permits the customer to view articles to be dispensed. Door 20 also supports a delivery box assembly 34 through which a dispensed article is accessible to the customer.

While we may provide our machine 10 with any practical number of delivery levels, in the particular embodiment illustrated in the drawings we provide four levels indicated generally respectively by reference characters 36, 38, 40 and 42. Each of the levels 36, 38, 40 and 42 is made up of a plurality of delivery units indicated generally respectively by reference characters 44. Each unit 44 is of the type which is especially adapted to dispense articles such as bagged snacks or the like.

At each level on side 14 we mount a pair of upper and lower roller-track-forming rails 50 and 52. A partition 54 in the cabinet 12 carries pairs of rails 50 and 52 at locations corresponding to the locations of the pairs of rails 50 and 52 on side 14. Since all of the levels 36, 38 and 40 are substantially identical, we will describe only the level 36 in detail. Level or shelf 36 includes a base 56, formed with a back panel 58 and provided with sides 60 and 62. We mount a pluralty of spaced rollers 64, 66, 68 and 70 along the lower edge of each of the sides 60 and 62. Each set of the rollers 64, 66, 68 and 70 is adapted to be received in a pair of the rails 50 and 52 to mount the shelf 36 for rolling movement inwardly and outwardly of the cabinet 12.

We mount a respective pivot bracket 72 at the forward end of each of the rails 52 associated with the tray 36. We provide the supporting shaft of each roller 68 of the level with an inwardly directed extension 76 adapted to be received in a hook 74 on the associated bracket 72 when the shelf is rolled outwardly. When the shelf has been rolled outwardly to a position at which the extensions 76 engage in hooks 74 the rear rollers 70 are aligned with slots 78 in the upper rails 50 associated with the tray. From this position the tray can be pivoted downwardly around extensions 76 until the back panel 58 engages stop pins or rollers 80. In this position of the tray it is readily accessible to the serviceman for loading.

Figure 6:
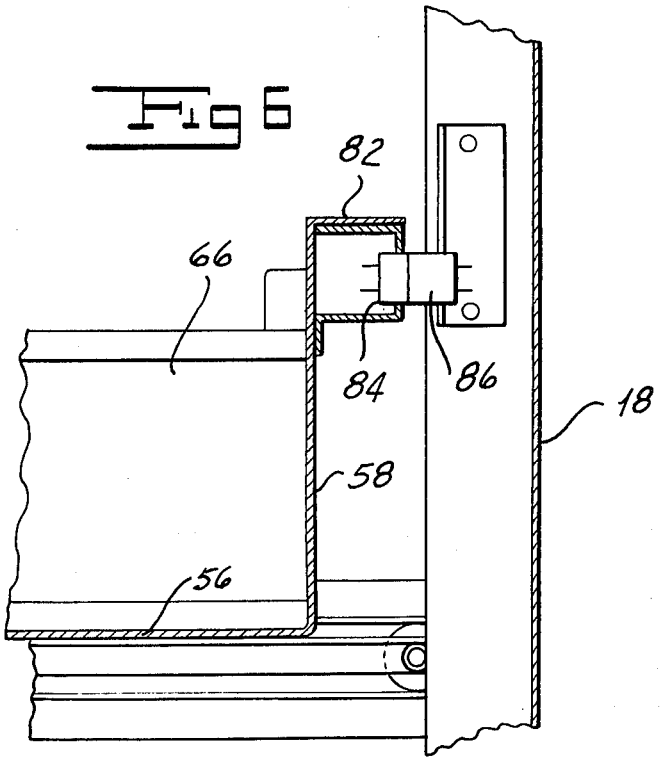
FIG. 6 is a fragmentary sectional view of one of the levels of our versatile merchandising machine illustrating the manner of making electrical circuit connections to a unit.
Figure 8:
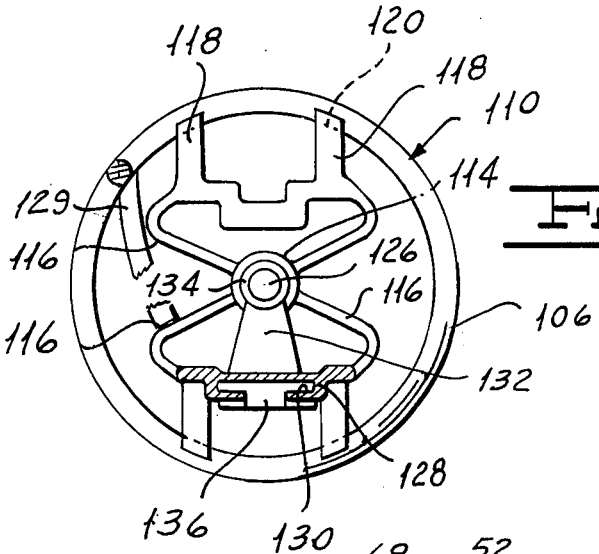
FIG. 8 is a fragmentary sectional view of the unit shown in FIG. 7 taken along the line 8—8 thereof.
Figure 5:
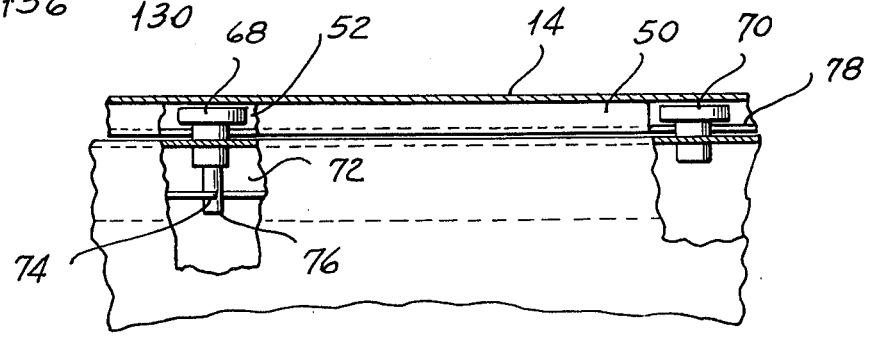

Referring to FIG. 6, back panel 58 carries a bracket 82 supporting a plug 84 adapted to be inserted into a receptacle 86 supported adjacent to the back 18 of the cabinet. As will more fully be pointed out hereinbelow, when a tray is slid outwardly for loading the plug 84 is disengaged from receptacle 86. As the tray is slid back into its home position, plug 84 automatically engages in receptacle 86.

Referring again to FIG. 2, we mount a pusher foot 88 on each tray adjacent to the front at the right edge thereof as viewed from the front. In the event that a tray is not slid fully into its home position by the serviceman after he had loaded the tray, as the door closes it engages foot 88 to move the tray fully into its home position. This action serves to ensure re-establishment of the electrical connection provided by plug 84 and receptacle 86. In addition, it ensures that the forward edge of the tray is out of the path of articles falling from delivery units above.

Referring now to FIGS. 2 and 7 to 9, we provide each tray with a plurality of partitions 90, spaced across the width of the base 56 and extending from front to back of the tray to separate the respective units 44. A pair of uprights 92 and 94 secured to the sides 60 and 62 adjacent to the front of the tray support a bar 96 extending across the tray at the front thereof. The bar 96 is provided with a plurality of openings spaced across the front thereof for receiving the resilient fingers 100 of a plurality of article guide rod supports 98. These supports are adapted to be releasably attached to the bar by snapping the fingers 100 into the bar openings. These supports 98 may carry indicia to correlate the various units with the push buttons of the array 24. They may, in addition, as indicated in FIG. 2, carry pricing information and selection letters which permit the units 44 to be associated with the buttons of array 24.

We connect a plurality of article guide rods 102 to the respective supports 98 by means of connectors 104. The element 102 may itself be made of flexible tubing or the like and the connector be rigid. Alternatively, the elements 102 can be rigid and may be provided with a flexible connector extending from the upper end of the rod to the support 98. We have discovered that the rods 102 function most effectively if they extend downwardly to a point just below front edge of base 56. These members control the movement of a light article as it moves over the edge of the shelf in a manner to be described to prevent it from falling forward or tumbling, as a result of which it might become wedged between the window and the shelf structure. In addition, these elements prevent a product being delivered from a higher shelf from striking the forward edge of a lower shelf. Thus, they cause a dispensed article to move downwardly from the shelf to the delivery box 34 without difficulty. In addition, the supports 98 affords visual association between a product and the displayed price at which the product is sold.

Each of the units 44 includes a pair of helices 106 and 108 which are wound in opposite directions. We provide a respective mounting spider indicated generally by the reference character 110 associated with each of the helices 106 and 108. Spider 110 includes a shaft 112 and a hub 114 from which resilient arms 116 extend to helix supports 118. We provide the outer extremities of the supports 118 with grooves 120 which are adapted to receive, for example, the last two closely spaced turns 122 of the associated helix. It will readily be appreciated that the spider may be compressed so that the helix supports 118 can easily be inserted into the last two turns 122 of the helix and then released to receive the turns. In addition, we provide the spider shaft with splines to permit adjustment of the initial rotary position of the helix with respect to its drive member in a manner to be described. We so arrange the initial positions of the helices 106 and 108 of each unit as best suits the particular product being dispensed by the unit. A bushing 124 or the like in the back panel 58 rotatably receives the portion of the shaft 112 extending through the panel. We provide each helix with an article-supporting bar 128 extending from front to back of the helix on which the bottoms of the bags or the like to be dispensed rest. Each of the bars or supports 128 is formed with a re-entrant channel 130 in the underside thereof. A rear clip 132 is formed with a collar 134 adapted to fit over a forward extension 126 on the shaft 112. The clip 132 is formed with a connector 136 having such a cross sectional shape as permits it to be inserted into the channel 130 from the rear thereof.

A front clip 138 formed with a pair of resilient legs 140 which permit it to be snapped into an opening 142 in the base 56 formed with a connector 144 having such a cross sectional shape as permits it to be inserted into channel 130 at the front of the support 128.

From the structure thus far described, it will be seen that each helix is readily removably mounted on the spider 110. Moreover, each of the article supporting members 128 is readily removably assembled with the shelf and with the spider. Owing to this arrangement the assembly may readily be taken apart for cleaning and, if desired, the initial rotary position of the helix can be changed with ease. We form each helix 110 with a tail 129 adapted to be engaged by the bend at the outer ends of one of the spider arms 116 to ensure that the helix 110 rotates with the spider and to prevent slippage therebetween.

Figure 7:
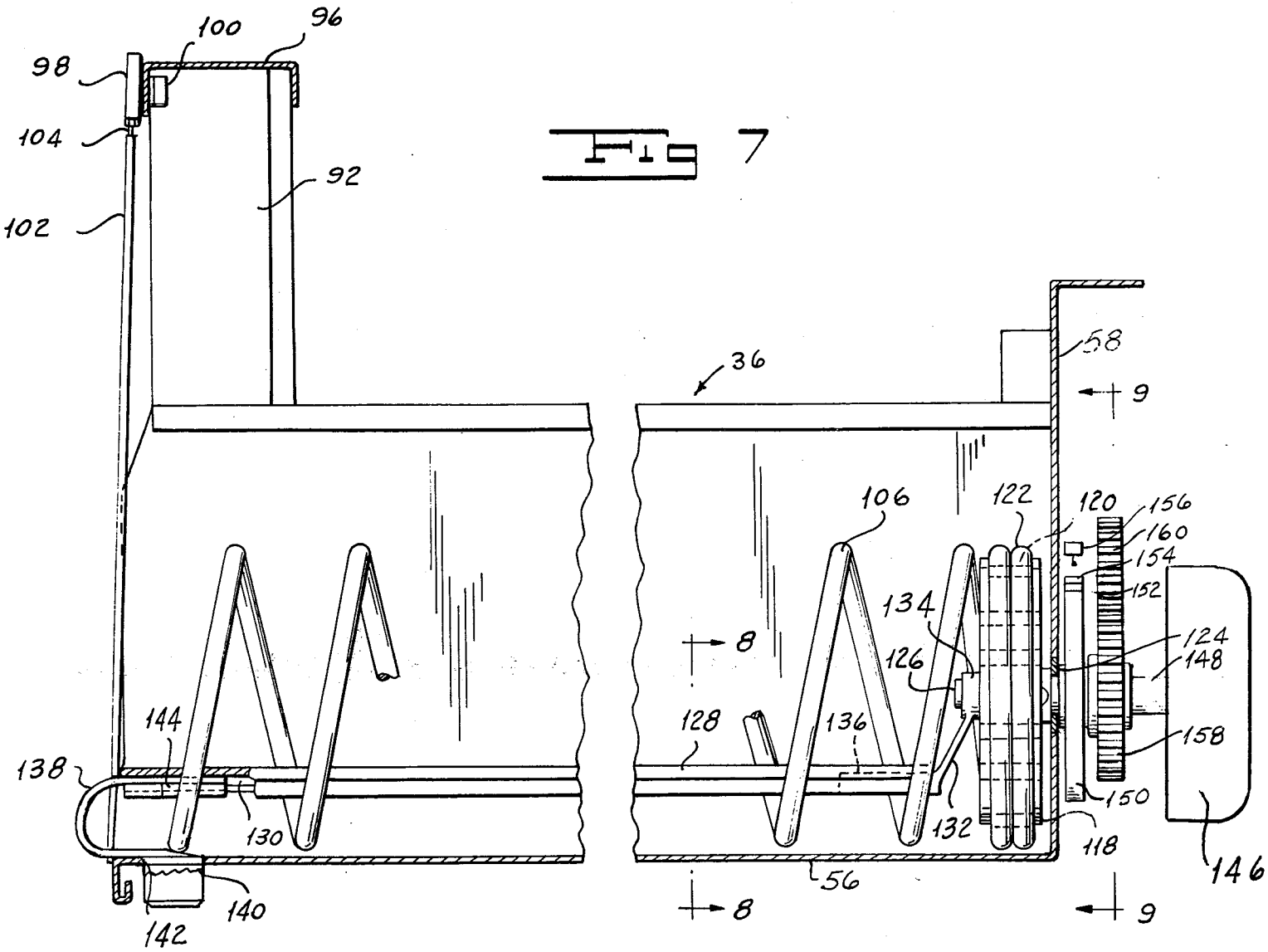
FIG. 7 is a sectional view of one of the delivery units of one of the shelves of our versatile merchandising machine.

Referring now to FIGS. 7 and 9, we provide a respective detent motor and gear box assembly 146 associated with each of the units. Each assembly 146 has an output shaft 148. We mount a detent cam 150 on the shaft 148 for rotation therewith. The detent recess 151 in cam 150 is adapted to receive a detent 152 which is urged into engagement with cam 150 by a relatively heavy spring arm 154. When detent 152 has moved fully out of recess 151, it is adapted to actuate a one-revolution switch 156. We so construct the detent as to require a predetermined rotary movement of shaft 148 before switch 156 operates. For example, we may so arrange the system that arm 154 does not operate switch 156 until shaft 148 has moved through 10° of rotation. If not, then arm 154 moves detent 152 fully back into notch 151 to restore shaft 148 to its initial position. This arrangement prevents a dishonest person from cheating the machine by lightly tapping the buttons while operating the coin return so as to obtain merchandise without payment. It will readily be appreciated that the cam and detent may be made a part of the unit 146.

We mount a gear 158 on shaft 148 for rotation therewith. The splined shaft 112 adjustably connects helix 106 to a coupling carried by shaft 148. Gear 158 is adapted to drive a pair of idler gears 160 and 162 rotatably supported on a bearing bracket 164. Gear 162 drives a gear 166 carried by the shaft 112 of the spider associated with helix 108.

Referring to FIG. 10, the push button array 24 includes a plurality of mounting strips 172 secured to the inside of door 20 behind a row of push button openings. Each strip 172 is integrally formed with a plurality of rearwardly opening recesses 174 and intermediate vertical openings 176. Each selector switch assembly 178 has an activating element 180. Each assembly 178 is adapted to be slid into a recess 174 past a boss 184 carried by an integrally resilient arm 182 until the boss drops in a recess in the switch housing releasably to hold the assembly in position on strip 172.

Each push button 186 is formed with a window 188 and with a pair of resilient fingers 190 and 194. Fingers 190 are formed with grooves 192. An indicia bearing sheet 196 is adapted to be held in position by a frame 198. It may carry a letter to facilitate association of the button with the corresponding unit 44 by means of the selection indicator on support 98.

After the assemblies 178 have been positioned in the recesses 174 the assembly of a push button 186, a sheet 196, and a frame 198 is moved downwardly so that leg 190 extends downwardly through one opening 176 until the lower edge of notch 192 passes through the bottom of that opening and the other leg 194 extends downwardly through an adjacent opening 176. Actuating element 180 of the corresponding switch biases the assembly to an upper limit position from which it can be moved to operate member 180.

Referring to FIG. 12, rather than using the rods 102 illustrated in FIGS. 1, 2 and 7, we may employ an arrangement in which a support 222, similar to support 98, carried by frame member 96 is connected by a spring 224 to a flag 226 carrying price and selection information. Flag 226 in turn carries a rod 228 which extends downwardly over the edge of shelf 56 as do rods 102. This arrangement more closely associates selection and pricing information with the product in the unit.

Referring now to FIG. 11, we have illustrated one form of electrical control circuit which may be used with one of the levels of our helical feed merchandising machine. A transformer 204 is adapted to couple a source of a suitable voltage such, for example, as 115 volts, 60 Hz on lines 200 and 202 to lines 206 and 208 to provide a control circuit operating voltage of, for example, 24 volts. Lines 206 and 208 provide an operating voltage for a suitable money totalizer 210 known to the art which is adapted to energize respective price lines 212, 214, 216 and 218 representing the deposit in the totalizer 210 of various sums. In the particular arrangement shown, line 212 may, for example, correspond to the highest price at which an article is sold, while line 218 corresponds to the lowest price at which an article is sold. A coin return electromagnet in the totalizer 210 is normally energized to enable the mechanism to accept coins.

The control circuit includes a transfer relay winding TR having associated therewith respective switches TR1 through TR5. As will be more fully explained hereinbelow, relay winding TR normally is energized so as to hold the switches in engagement with the lower contacts illustrated in FIG. 11 and upon deenergization to permit the switches to engage the upper contacts shown in the FIGURE. In the circuit of FIG. 11, each of the price setting switches **168*a* and 168*e* associated respectively with units 44 of a level is adapted to be actuated selectively to engage one of four contacts connected respectively to the price lines 212, 214, 216 and 218. Each of the push button switches 180*a* through 180*e* associated with the respective units 44 of a level normally engages an upper contact illustrated in FIG. 11 and is adapted to be moved into engagement with a lower contact. Each of the full cycle switches 156*a* to 15*e* associated with the units 44 of a level is normally in engagement with an upper contact in FIG. 11 and is adapted to be moved into engagement with a lower contact when the corresponding one of the motors 146*a* to 146*e* has moved through a sufficient distance to cause spring arm 154 to operate the swtich 156.**

With the power on in the control circuit winding TR normally is energized from line 206 through the winding and through all of the switches **156*a* to 156*e* to line 208. When sufficient money has been deposited in register 210 to permit a selection to be made, the price line corresponding to the selected article is activated. When that occurs the corresponding push button switch 180 is operated to complete the circuit of the associated motor 146 to cause the motor to begin to rotate. If the push button switch is held closed for a sufficient length of time, detent 152 moves out of the detent recess in cam 150 and actuates switch 156. When that occurs the circuit of the corresponding motor 146 is maintained complete for a full revolution of the motor. At the same time, the circuit of winding TR is broken to cause all of the switches TR1 through TR5 to move from the condition shown in FIG. 11 in full lines to the condition shown in broken lines. This operation re-energizes electromagnet 220 and cancels the credit in register 210** so that when the motor completes a cycle of revolution the apparatus is ready for the next operation.

In connection with the form of our electrical circuit shown in FIG. 11, it is to be noted that the selecting and full cycle switches are between the motors and one side of the line while the pricing switches and coin totalizer are between the motors and the other side of the line. This arrangement has the advantage of permitting us to employ selection switches which are limited to single pole single throw switches rather than using double pole double throw switches as in the prior art. This arrangement enables us to operate at a multiplicity of different prices without breaking the string. That is, placing of the multiple position price setting switches on the return side of the motors greatly facilitates the use of multiple price credit mechanisms and simplifies the circuitry.

In operation of our spiral feed merchandising machine, when a sum in money aggregating at least a purchase price of a desired article has been deposited in the totalizer 210, the corresponding selecting push button switch 180 is operated. As a result, the associated motor is energized to drive detent cam 150. After about 10° of rotation of the cam, the detent 152 will have moved out of the cam recess and arm 154 will operate switch 156 to cause the motor to travel through a full revolution. In the course of that revolution, the two helices 106 and 108 of the unit are driven in opposite directions to advance the leading article over the edge of the shelf 56. As the article moves over the edge of the shelf its orientation is controlled by the flexible rod 102 to ensure that the package will not tumble and become wedged between a shelf and the window. Control rods 102 below the level from which an article is dispensed prevent the falling article from engaging the edge of a lower shelf.

When it is desired to load the machine, the shelf can be slid outwardly until the pin on the next to rear roller 68 engages the hook 74 at which time the rearmost roller 70 will be aligned with the slot 78. The shelf can be pivoted until the back 58 of the shelf engages the stop pins or rollers 80. The machine can then be loaded. After loading the shelf is restored to its initial position and the electrical connection provided by plug 84 and receptacle 86 is re-established. If for any reason the shelf is not in a fully home position as the door is swung to a closed position it engages the foot 88 on the shelf to move it into a fully home position. The price at which any article is to be sold can readily be changed by operating the switch 168 located at the rear of the unit containing the article.

It will be seen that we have accomplished the objects of our invention. We have provided a versatile merchandising machine which overcomes the defects of helical feed machines of the prior art. Our machine minimizes the possibility that a dispensed article will not reach the delivery area. Our machine is relatively easy to clean. It is simple to load. The operating mechanism thereof is relatively simple as compared with operating mechanisms of the prior art.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A merchandising machine including in combination, a cabinet, a plurality of shelves, a plurality of merchandise delivery units on each of said shelves, means mounting said shelves in said cabinet in superposed relationship with the forward edges thereof spaced rearwardly of the front of said cabinet, said delivery units adapted to be actuated to deliver articles over the forward edges of said shelves, a plurality of flexible fingers, and means mounting said fingers respectively over said units with free ends thereof extending downwardly in front of the associated unit, the said units being vertically aligned and the length of said fingers being such that the free end of a finger associated with a unit on a lower shelf extends downwardly over the forward edge of the lower shelf to prevent an article delivered by an upper shelf unit from striking the forward edge of said lower shelf.

2. In a merchandising machine having a plurality of delivery units, a control system including a source of electrical potential having a pair of terminals, respective drive motors associated with said delivery units, each of said drive motors having a pair of terminals and an output shaft occupying a home position with said machine inactive, a plurality of price lines, totalizer means for connecting said price lines to one terminal of said source in response to the deposit of money in the totalizer, a plurality of multiple position price selection switches, means connecting said price selection switches between said price lines and respective first terminals of said motors, a plurality of normally open single pole double throw selection switches, means connecting said selection switches between the other terminal of said source and respective second terminals of said motors, each of said selection switches being adapted to be actuated to energize its associated motor to move its shaft out of said home position, and means responsive to movement of said shaft out of its home position for bypassing its associated selection switch.

3. In a merchandising machine having a plurality of delivery units, a control system including a source of electrical potential having a pair of terminals, respective energizable devices associated with said delivery units, each of said devices having a pair of terminals and an element moveable in response to energization of the device and normally occupying a home position, a plurality of price lines, totalizer means for connecting said price lines to one terminal of said source in response to the deposit of money in the totalizer, a plurality of multiple position price selection switches, means connecting said price selection switches between said price lines and respective first terminals of said devices, a plurality of normally open single pole double throw selection switches, means connecting said selection switches between the other terminal of said source and respective second terminals of said devices, each of said selection switches being adapted to be actuated to energize its associated device to move its element out of said home position, and means responsive to movement of said element out of its home position for bypassing its associated selection switch.

4. In a merchandising machine, apparatus including, a shelf, a plurality of pairs of helical article delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the associated pair, means for selectively energizing said drive motors, respective article supporting members extending through each of said helical members, and means including respective clips having resilient fingers adapted to engage in openings in said shelf for manually removably mounting said article supporting members on said shelf.

5. In a merchandising machine, apparatus including, a shelf, a plurality of pairs of helical delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the associated pair, and means for selectively energizing said drive motors, said driving means each including a pair of shafts and hubs on said shafts and resilient fingers extending between said hubs and said helical members for manually removably mounting the respective helical members of a pair on said shafts.

6. In a merchandising machine, apparatus including, a shelf, a plurality of pairs of helical article delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the associated pair, and means for selectively energizing said drive motors, said means for selectively energizing said drive motors including a push-button switch assembly comprising a frame having a recess therein, a switch having an acutating element, first interengageable means on said switch and on said frame for manually readily releasably mounting said switch in said frame recess with said actuating element exposed, a push-button and second interengageable means on side bush-button and on said frame for readily manually releasably mounting said push-button on said frame over said actuating element and for limited movement toward and away from said switch.

7. Apparatus as in claim 6 in which said first interengageable means comprises a spring finger on said frame adjacent to said recess, a boss on said finger and means forming a recess in said switch for receiving said boss.

8. Apparatus as in claim 6 in which said frame recess is a laterally opening recess having an open top, and in which said second interengageable means comprises means forming vertical openings in said frame at the sides of said recess and fingers on said push button extending into said vertical openings.

9. In a merchandising machine, apparatus including, a shelf, a plurality of pairs of helical article delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the asosciated pair, and means for selectively energizing said drive motors, said means for selectively energizing said drive motors comprising a control circuit including a plurality of price-setting switches associated respectively with said pairs of helical members and means mounting said switches on said shelf respectively adjacent to said pairs of members whereby the association of a switch with a pair of helical members is immediately apparent.

10. In a merchandising machine, apparatus including, a shelf, a plurality of pairs of helical article delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the associated pair, and means for selectively energizing said drive motors, said means for selectively energizing said drive motors comprising a source of electrical power having a pair of terminals, a plurality of selector switches, means connecting said selector switches between a first terminal of said source and respective first terminals of said motors, a plurality of price-setting switches and means connecting said price-setting switches between the second terminal of said source and respective second terminals of said motors.

11. In a merchandising machine, apparatus including, a shelf, a plurality of pairs of helical article delivery members, means mounting the members of each pair in side-by-side relationship with the lower portions of the turns thereof closely adjacent to said shelf and with each pair of aligned interturn spaces of the respective helical members of the pair adapted to receive a respective article, a plurality of individually energizable drive motors associated respectively with said pairs of helical members, respective means each including one of said drive motors for driving the helical members of the associated pair, each of said motors having a pair of terminals and having an output shaft, said shafts being oriented to home positions in the inactive condition of said apparatus, and means for selectively energizing said drive motors, said energizing means including a source of electrical potential having a pair of terminals, a plurality of price lines, totalizer means for connecting said price lines to one terminal of said source in response to deposit of money in the totalizer, a plurality of multiple position price selection switches, means connecting said price selection switches between said price lines and respective first terminals of said motors, a plurality of normally open single pole double throw selection switches, means connecting said selection switches between the other terminal of said source and respective second terminals of said motors, each of said selection switches being adapted to be actuated to energize its associated motor to move its shaft out of said home position, and means responsive to movement of said shaft out of its home position for bypassing its associated selection switch.

12. In a merchandising machine, apparatus including a plurality of shelves, a plurality of pairs of helical article delivery members, means mounting the members of each pair in side-by-side relationship with the lower portions of the turns thereof closely adjacent to the associated shelf and with each pair of aligned interturn spaces of the respective helical members of the pair adapted to receive a respective article, said helical members adapted to be driven to deliver articles over the forward edges of their associated shelves, the pairs of article delivery members on an upper shelf being vertically aligned with the pairs of article delivery members of a lower shelf, a plurality of flexible fingers, means mounting said fingers respectively over the pairs of delivery members on the lower shelf with the free ends thereof extending downwardly, the length of said fingers being such that the free ends extend over the forward edge of said lower shelf to prevent an article delivered by an upper shelf article delivery member pair from striking the forward edge of the lower shelf, a plurality of individually energizable drive motors associated respectively with said pairs of helical members, respective means each including one of said drive motors for driving the helical members of the associated pair, and means for selectively energizing said drive motors.

13. In a merchandising machine, apparatus including a plurality of drive motors each having a shaft and a pair of terminals, a source of power having a pair of terminals, a plurality of price lines, money responsive means for connecting said price lines to one terminal of said source, respective price setting switches connected between first terminals of said motors and said price lines, respective selection switches connected between second terminals of said motors and the other terminal of said source, first means responsive to energization of one of said motors for connecting the second terminal of said one motor to said other terminal of the source, and second means responsive to energization of said one of said motors for bypassing said money responsive means and for disabling said selection switches.

14. Apparatus as in claim 13 in which said selection switches are connected in series.

15. Apparatus as in claim 13 in which said means for bypassing said money responsive means comprises a normally energized relay adapted to be deenergized upon energization of one of said motors.

* * * * *

UNITED STATES PATENT AND TRADEMARK OFFICE

CERTIFICATE OF CORRECTION

PATENT NO. : 4,023,704

DATED : May 17, 1977

INVENTOR(S) : Irving Pitel, Richard S. Silverman and Richard J. Mueller

It is certified that error appears in the above-identified patent and that said Letters Patent are hereby corrected as shown below:

Column 9, line 36, "acutating" should read

-- actuating --;

line 40, "side" should read -- said --;

line 41, "bush-button" should read

-- push-button --;

line 66, "asosciated" should read

-- associated --.

Signed and Sealed this

*Thirteenth* Day of *September 197*

[SEAL]

*Attest:*

RUTH C. MASON
*Attesting Officer*

LUTRELLE F. PARKER
*Acting Commissioner of Patents and Trademark*